United States Patent [19]

Baron et al.

[11] 4,105,886

[45] Aug. 8, 1978

[54] MICROWAVE ENERGY FEED SYSTEM FOR COMBINATION COOKING APPARATUS

[75] Inventors: David Alan Baron, Edina; James Ronald Hampton, Brooklyn Center, both of Minn.

[73] Assignee: Litton Systems, Inc., Beverly Hills, Calif.

[21] Appl. No.: 702,489

[22] Filed: Jul. 6, 1976

[51] Int. Cl.[2] ..... H05B 9/06

[52] U.S. Cl. ..... 219/10.55 E; 219/10.55 F

[58] Field of Search ..... 219/10.55 E, 10.55 F, 219/10.55 B, 10.55 R

[56] References Cited

U.S. PATENT DOCUMENTS

| | | | |
|---|---|---|---|
| 2,748,239 | 5/1956 | Long et al. | 219/10.55 F |
| 2,813,185 | 11/1957 | Smith | 219/10.55 F |
| 2,860,026 | 11/1958 | Long | 219/10.55 B |
| 2,919,336 | 12/1959 | Hahn | 219/10.55 R |
| 2,920,174 | 1/1960 | Haagensen | 210/10.55 F |
| 3,106,629 | 10/1963 | Schall | 219/10.55 F |
| 3,177,335 | 4/1965 | Fitzmayer et al. | 219/10.55 R |
| 3,641,301 | 2/1972 | Ikeda | 219/10.55 F |
| 3,975,606 | 8/1976 | Tanaka et al. | 219/10.55 F |

FOREIGN PATENT DOCUMENTS

| | | | |
|---|---|---|---|
| 723,245 | 12/1965 | Canada | 219/10.55 E |

*Primary Examiner*—Bruce A. Reynolds
*Attorney, Agent, or Firm*—Robert E. Lowe

[57] ABSTRACT

A domestic cooking appliance which is adapted to provide both conventional thermal cooking and microwave cooking in a single cavity is disclosed. The appliance includes a microwave energy feed system having a housing located outside of the cooking cavity, the housing containing both a microwave generator antenna and a rotatable energy deflector. The housing is covered with a microwave transparent material that is able to withstand conventional cooking and pyrolytic cleaning temperatures.

1 Claim, 3 Drawing Figures

FIG. 1
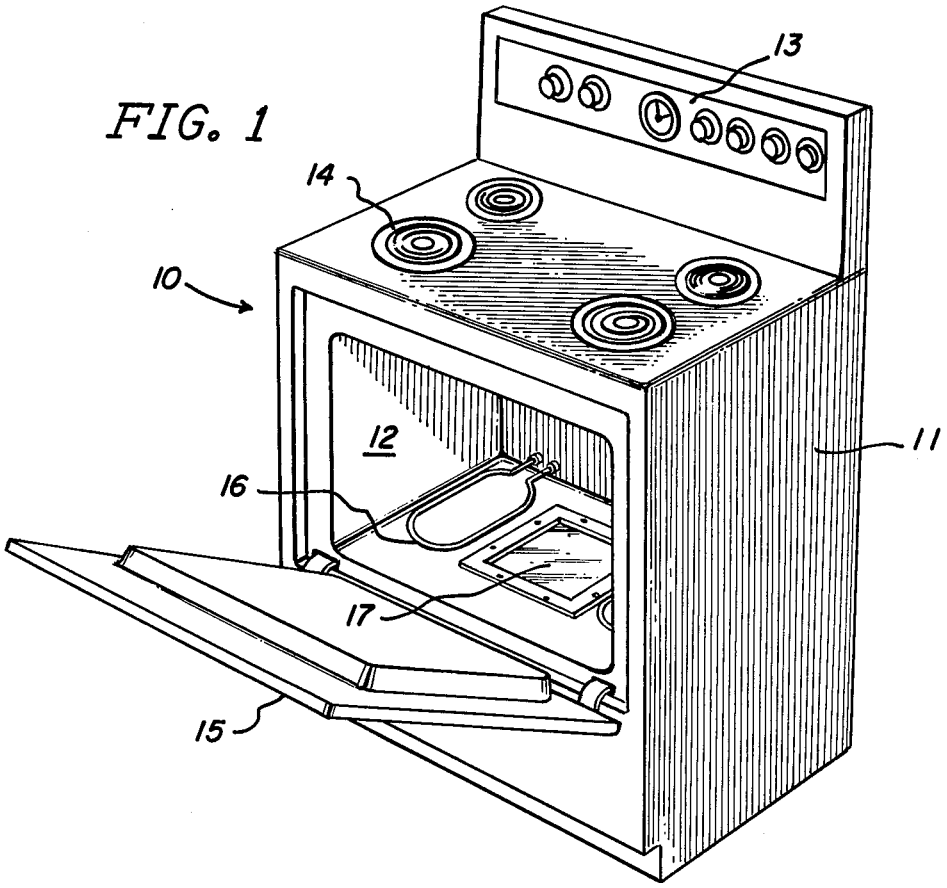
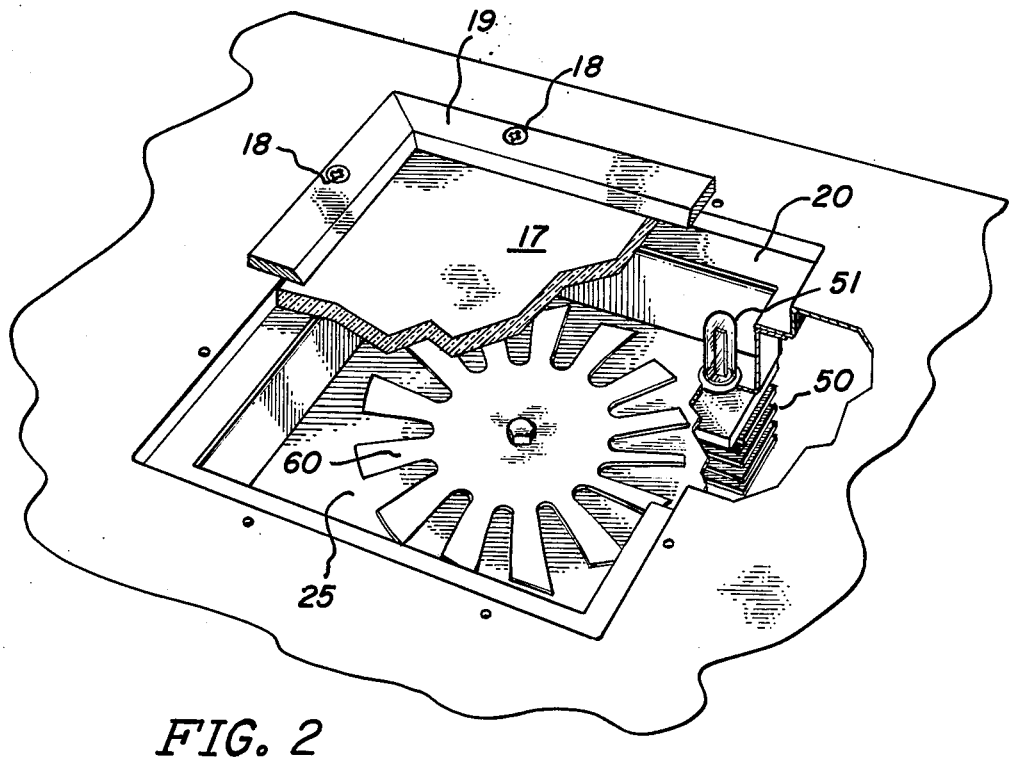
FIG. 2

MICROWAVE ENERGY FEED SYSTEM FOR COMBINATION COOKING APPARATUS

BACKGROUND OF THE INVENTION

This invention relates to the field of cooking appliances, and more specifically to the field of cooking appliances configured to cook foods by the application of conventional thermal heat, or by the application of microwave energy, or by the simultaneous application of both thermal and microwave energy. The latter technique is hereinafter referred to as "combination cooking."

Although combination cooking appliances have been known heretofore, such prior art devices have had a number of drawbacks. The addition of microwave energy to a conventional free standing range presents a number of difficulties in the areas where conventional, thermal heating techniques and microwave heating techniques are not readily compatible.

In one type of prior art appliance, microwave energy is coupled into the cooking cavity by means of a coaxial transmission line terminating in an antenna located in the cavity itself. In order to avoid the creation of standing wave patterns, a stirring device is located in the cavity. The device is reflective of microwave energy and is mounted so as to rotate within the cavity to provide better dispersion of the microwave energy patterns. Such a system takes up valuable space within the cavity, is unattractive, and can present difficult soil cleaning problems.

SUMMARY OF THE INVENTION

Accordingly, it is an object of the present invention to provide a combination cooking appliance including means for supplying microwave energy to the cooking cavity without encumbering the cooking space with microwave associated hardware.

A further object of the invention is to provide a microwave energy feed system for a combination cooking appliance that provides for efficient delivery of microwave energy in a good cooking pattern.

Other objects and advantages of the invention will become obvious as the description proceeds.

The present invention provides a domestic cooking appliance adapted to perform either conventional thermal cooking or microwave cooking, or both simultaneously in a single cavity. A microwave energy feed system is provided located outside of the cooking cavity area, the feed system including a housing, a microwave generator having an antenna projecting into the housing, an energy deflector mounted for rotation in the housing, and a cover between the cooking cavity and the housing, the cover allowing for the passage of microwave energy and being able to withstand the temperatures present in the cooking cavity.

BRIEF DESCRIPTION OF THE DRAWINGS

The invention will be more particularly described by reference to the attached drawings in which:

FIG. 1 is a perspective view of a domestic range having the door opened to expose the interior oven cavity in part;

FIG. 2 is an enlarged, cut-away perspective of a portion of the bottom wall of the oven cavity showing detailed construction of the microwave feed area; and, FIG. 3 is a front elevational view, partly in section, of the range shown in FIG. 1.

DESCRIPTION OF PREFERRED EMBODIMENTS

Figure 3:
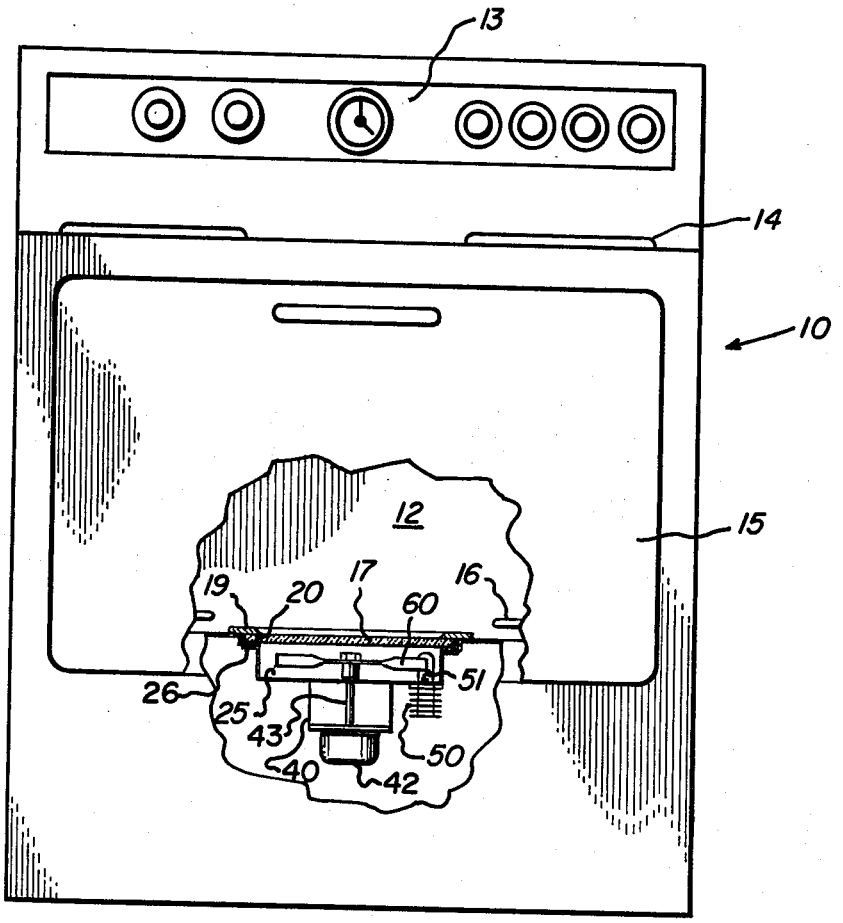

FIG. 1 depicts a domestic cooking appliance or range 10 having a cabinet 11, an oven cavity 12, and a control panel 13. Conventional surface heating elements 14 are provided in the top portion of cabinet 11. An oven door 15 hingedly mounted on the front portion of the range is adapted to close off the front portion of oven cavity 12 to form an enclosed cooking space.

The interior of the oven cavity 12 is equipped with conventional heating elements 16 of known resistance heating type. It will be appreciated that the present invention can also be adapted to an oven cavity to which heat is supplied by means of gas as well as by the electric heating elements 16 as shown.

The construction of the bottom wall of the oven cavity 12, and especially the central portion thereof, is shown in detail in FIG. 2. The bottom wall of the cavity has a portion cut-away, such portion being generally rectangular in shape for ease of manufacture, although other non-rectangular shapes can be employed as well. Coextensive with the cut-away portion is a recessed flange 20 forming an aperture slightly below the bottom surface of the oven cavity. The rectangular window thus formed in the bottom wall is covered by plate 17, the plate resting upon flange 20 and being secured in position by framing bezel 19. The bezel is fastened to the bottom wall of the cavity 12 by sheet metal screws or other suitable fasteners 18.

The plate 17 forms a portion of the oven bottom when in place, and therefore must be made from a material able to withstand the temperatures normally encountered in cooking. If the oven is adapted for pyrolytic self-cleaning even higher temperatures will be periodically encountered, and in such case plate 17 should be able to withstand temperatures in excess of 1000° F without damage or degradation. As will be discussed more fully hereafter, plate 17 must also allow microwave energy to pass through it without absorbing a significant portion of the energy. Preferably, plate 17 is made from glass ceramic material, but other materials having the above described characteristics can also be used such as ceramic, aluminum oxide, boro-silicate glass, and other high temperature, high strength dielectric materials.

A housing 25 is mounted below the oven cavity 12 and sized and positioned to match the window portion. Housing 25 includes a peripheral flange portion 26 which substantially matches flange 20 in size and dimension so that housing 25 may be mounted below the oven cavity 12 by means of welding flange 26 to flange 20.

In order to provide microwave energy in the oven cavity 12, a microwave generator such as a magnetron 50 is provided. The magnetron is mounted to the underside of housing 25, the antenna portion 51 extending through an aperture into the interior of housing 25. Also mounted to the underside of housing 25 is a bracket 40 to which motor 42 is mounted, the motor shaft 43 extending into the interior of housing 25. A microwave energy deflector 60 is mounted to the end of shaft 43 for rotation within the housing.

Housing 25, plate 17, deflector 60 and magnetron 50 cooperate to form a microwave energy feed system for oven cavity 12. Microwave energy is initially propagated in housing 25 by the antenna 51. The energy waves thus emitted are deflected into random patterns as they are reflected from the rotating deflector 60. The energy passes through plate 17 into the cavity where a uniform cooking pattern is thus established.

Because the formation of standing wave patterns is discouraged in the housing 25 before the energy is transmitted into cavity 12, it is not necessary to have an energy deflector or stirrer located in the oven cavity itself. The feed system also makes the use of waveguides unnecessary while overcoming many of the energy pattern problems commonly associated with direct feed systems. Additionally, the housing 25 serves to provide a thermal insulating space between the oven cavity 12 and the magnetron 50 in order to protect the magnetron from unacceptably high operating temperatures.

While the invention has thus been described in detail for purposes of illustration, it will be understood that many modifications can be made by those skilled in the art without departing from the spirit or scope of the invention which is defined in the appended claims.

We claim:

1. A domestic cooking appliance having surface heating elements and an oven cavity, said oven cavity adapted to cook foods with either microwave energy alone or thermal energy alone or both simultaneously, thermal heating means mounted in said oven cavity, said cavity having a portion cut away from the bottom wall thereof;

microwave energy feed means subjacent said cavity in energy transmitting communication therewith through said cut-away portion, said feed means comprising a box-like housing of substantially smaller size and dimensions than said oven cavity mounted to the underside of said cavity, the perimeter dimensions of said housing substantially matching those of said cut away portion, a magnetron having an antenna portion extending directly into said housing, and energy deflecting means rotatably mounted in said housing;

covering means across said cut-away portion and covering said housing to prevent the egress of food materials from said cavity into said housing, said covering means being substantially transparent to microwave energy and able to withstand temperatures normally encountered in cooking.

* * * * *